US006089832A

United States Patent [19]

Patterson

[11] Patent Number: 6,089,832

[45] Date of Patent: Jul. 18, 2000

[54] THROUGH-TUBING, RETRIEVABLE DOWNHOLE PUMP SYSTEM

[75] Inventor: John C. Patterson, Garland, Tex.

[73] Assignee: Atlantic Richfield Company, Los Angeles, Calif.

[21] Appl. No.: 09/198,629

[22] Filed: Nov. 24, 1998

[51] Int. Cl.[7] ..... F04B 17/00

[52] U.S. Cl. ..... 417/360; 417/423.3; 417/424.2; 166/68.5

[58] Field of Search ..... 417/360, 410.3, 417/423.3, 424.1, 424.2, 422; 166/68, 68.5, 105

[56] References Cited

U.S. PATENT DOCUMENTS

| | | | |
|---|---|---|---|
| 3,411,454 | 11/1968 | Arutunoff | 417/360 |
| 4,197,879 | 4/1980 | Young | 137/629 |
| 5,746,582 | 5/1998 | Patterson | 417/360 |
| 5,871,051 | 2/1999 | Mann . | |
| 5,954,483 | 9/1999 | Tetzlaff | 417/360 |

FOREIGN PATENT DOCUMENTS 0 854 266A2 7/1998 European Pat. Off. .

OTHER PUBLICATIONS

Brochure: "Model "ML–2" and "MH–2" Tubing Retrievable Safety Valves", Baker Packers, Houston, Tx.

Brochure: Otis X–Line® and R–Line® Landing Nipples and Lock Mandrels, Halleburton, Dallas, Tx.

*Primary Examiner*—Timothy S. Thorpe
*Assistant Examiner*—Cheryl J. Tyler
*Attorney, Agent, or Firm*—Drude Faulconer

[57] ABSTRACT

A downhole pump system which allows the pump unit to be retrieved and re-installed through the production tubing while leaving the tubing, electrical cable, and the remainder of the components of the pump system in place. Preferably, the pump unit is run on a string of coiled-tubing through a lubricator which is positioned downhole in the production tubing. The pump unit includes a slip-joint at its upper end which (a) allows the length of the pump unit to be adjusted to compensate for the spacing between the seating surface and latching grooves in the nipple and (b) allows the pressures to be balanced across the pump unit during installation and retrieval.

7 Claims, 2 Drawing Sheets

FIG. 1
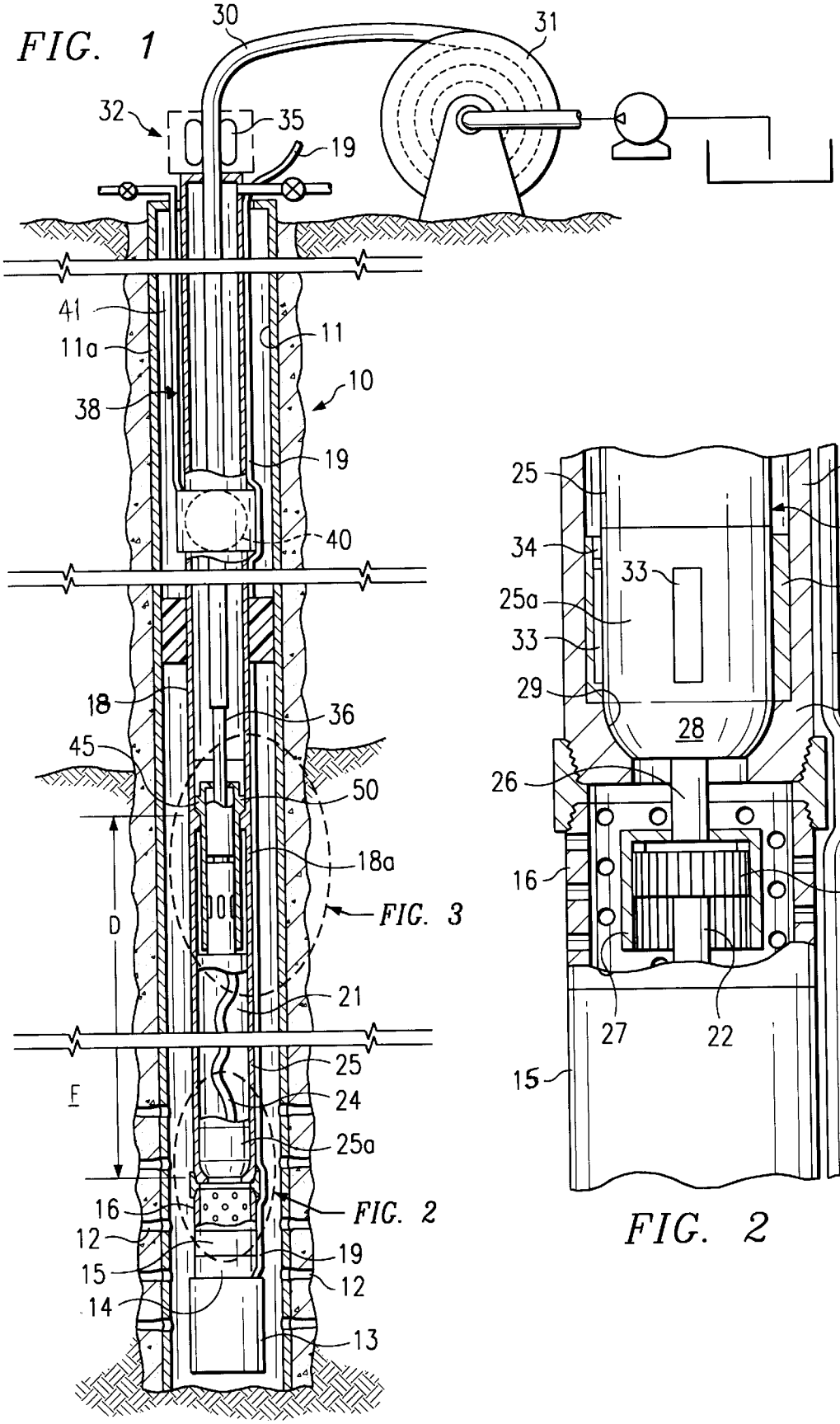
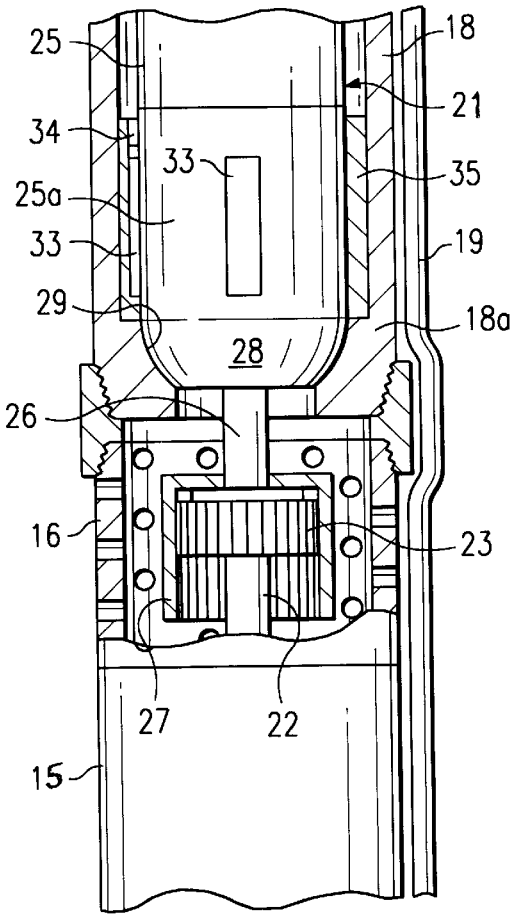
FIG. 2

THROUGH-TUBING, RETRIEVABLE DOWNHOLE PUMP SYSTEM

DESCRIPTION

1. Technical Field

The present invention relates to a downhole pump system wherein the pump section of the system can be retrieved through the production tubing without removing the tubing string and in one aspect relates to a downhole pump system which includes a downhole lubricator in the tubing string for retrieving the pump section through the tubing string. Further, the pump section may be positioned and retrieved by using either a wireline or a string of coiled tubing and includes a "slip-joint" which allows the pump section to be released without undue strain being applied to the pump section.

2. Background

Submersible, electrically-driven, downhole pump systems have long been used to lift produced well fluids to the surface. Typically, such systems are comprised of an electric motor, a "protection" section, and a pump which, in turn, is driven by the motor. All of these components are coupled together and suspended in the wellbore as a unit on the lower end of the production tubing through which the fluids are pumped to the surface. Electricity is transmitted to the downhole motor through a three-conductor armored cable which, in turn, is clamped to the outside of the tubing string.

The pump section in such systems section (hereinafter "pump"} is usually either a multistage, centrifugal pump or a progressive cavity pump (PCP). Centrifugal pumps are normally used to lift light and relatively clean fluids (i.e. oil and water) while PCPs are usually preferred when lifting more viscous and dirtier fluids (i.e. heavy oil laden with sand). Whether the pump is a centrifugal pump or a PCP, it will normally "wear-out" before the rest of the downhole system needs servicing.

Unfortunately, since the pump is installed with the downhole motor as a unit which, in turn, is mounted on the lower end of the production tubing, the entire string of tubing, the motor, and the pump must be pulled from the well each time the pump needs repair or replacement even though the motor, gear box, and protection section of the system are still in good operating condition. As will be understood by anyone working in this art, it is expensive and time-consuming to pull and then re-run the tubing, the associated electrical cable, and motor each time the downhole pump needs to be serviced or replaced.

Recently, a downhole pump system has been proposed wherein the only the pump section of the system is retrieved through the production tubing while leaving the tubing, electrical cable, and the other components of the system in place within the wellbore; see U.S. Pat. No. 5,746,582, issued May 5, 1998, and which is incorporated herein by reference in its entirety. In this system, an electric motor is affixed to the lower end of the production tubing and the electrical cable for supplying power to the motor is clamped to the outside of the tubing much in the same manner as is done in prior downhole pump systems.

The pump, however, be it a centrifugal pump or a PCP, is positioned within the tubing and has a releasable driving connection to the motor. This allows the pump to be retrievable and installable through the tubing without removing the string of tubing, the motor, or the electrical cable from the wellbore. This it typically done by raising and/or lowering the pump through the tubing on a wireline which is releasably connected to the pump. While this system will perform well in most situations, there are instances where further embodiments may be desirable.

For example, while wireline technology is well developed, there are certain instances where its use in installing and/or retrieving the pump through the tubing string may be severely limited; i.e. wireline tools have problems operating in (a) horizontal or high-angled wellbores (e.g.. 60° or greater); (b) wells with high sand production where sand may accumulate in the wellbore; and (c) wells in which the wellbore is filled with highly-viscous fluids (e,g. heavy crude). In each of these instances, the weight of the tool is the only "driving" force which forces the tool downward in the hole. It can be seen that if the wellbore is horizontal or at a high angle, the tool will lie on the low side of the wellbore and will not advance therein. Likewise, where sand has accumulated in the wellbore, the tool will engages this sand and can not work its way downward therethrough. In the case of highly-viscous liquids, the tool will "float" and become suspended in the fluid as it becomes submerged therein and the wireline becomes useless in lowering the tool further in the wellbore.

Another problem which may be encountered in installing and retrieving a pump through the tubing string is the exact spacing which is required between (a) the upper latching means which releasably secures the pump in the tubing during operation and (b) the releasable driving connection between the pump and the downhole motor. There needs to be some play between the pump and these respective connecting means in the tubing so that the installation of the pump can be easily accomplished when the pump is lowered into place. Further, considerable upward force must be applied to the pump when the pump is initially lifted within the tubing to release the latching means and if this force is not compensated for in some way, it can cause significant damage to the pump and the remainder of pump system left in the wellbore.

SUMMARY OF THE INVENTION

The present invention provides a downhole pump system for lifting production fluids from a production zone in a wellbore which allows the pump unit to be retrieved and re-installed through the production tubing while leaving the tubing, electrical cable, and the remainder of the components of the pump system in place. Basically, the pump system is comprised of a production tubing string adapted to extend from the production zone to the surface. An electric motor is fixed to the bottom of the tubing and is connected to an electrical cable which, in turn, is paid out and is attached to the outside of the production tubing as the tubing is lowered into the wellbore.

A pump unit, which is releasably positioned within the tubing, is releasably connected to the motor whereby the motor will drive the pump when electricity is supplied thereto through the cable. This allows the pump unit to be both retrievable and installable through the tubing without removing the production tubing string, the motor, or the electrical cable from the wellbore. Preferably, the downhole pump unit is run into and out of the wellbore on a string of coiled-tubing.

The production tubing includes a landing nipple which is positioned adjacent the production zone when the tubing is in place within the wellbore. The tubing also includes a lubricator sub which is positioned at least 50 feet below the surface. The lubricator is comprised of a length of conduit which forms a part of the tubing string and has a full-open, fail-safe, hydraulically operated ball valve which isolates the lubricator from the production tubing below the valve whereby the pump unit can be inserted into or removed from the production tubing at the surface without venting the downhole pressures to the atmosphere. By positioning the lubricator downhole, the need for an above-ground lubricator which would have to extend upward for a substantial distance above the wellhead is eliminated.

Further, the retrievable pump unit includes a slip-joint at its upper end which allows the length of the pump unit to be adjusted to compensate for the distance between the seating surface in the nipple and grooves within the nipple which are adapted to receive the latching dogs of the releasable latching means carried by slip-joint. Also, relative movement of the slip-joint allows the pressures to be balanced across the pump unit during installation and retrieval which, in turn, reduces the forces on the pump unit thereby reducing the risk of severe damage to the pump unit.

More specifically, the slip-joint is comprised of a first member which is slidably mounted on the outlet conduit of the pump unit and a second member which is slidably mounted on the first member; the second member carrying the releasable latch means, i.e. retractable latch dogs. The first member and the second members are in their extended position in relation to each other when the pump unit is being installed and retrieved and are in their retracted position when the pump unit is latched within the nipple. The first member, second member, and the outlet conduit of the pump unit all have openings therein which align when the slip-joint is in its extended position to thereby provide a fluid passage for equalizing the pressures across the pump unit so that the pump unit can easily be lowered during installation and so that it can easily be unlatched and retrieved through the tubing when the unit needs to be serviced and/or replaced.

BRIEF DESCRIPTION OF THE DRAWINGS

The actual construction, operation, and apparent advantages of the present invention will be better understood by referring to the drawings which are not necessarily to scale and in which like numerals identify like parts and in which:

FIG. 1 is an elevational view, partly in section, of a wellbore having the downhole pump system of the present invention installed therein;

FIG. 2 is an enlarged, detailed sectional view taken within line 2—2 of FIG. 1;

BEST KNOWN MODE FOR CARRYING OUT THE INVENTION

Figure 3A:
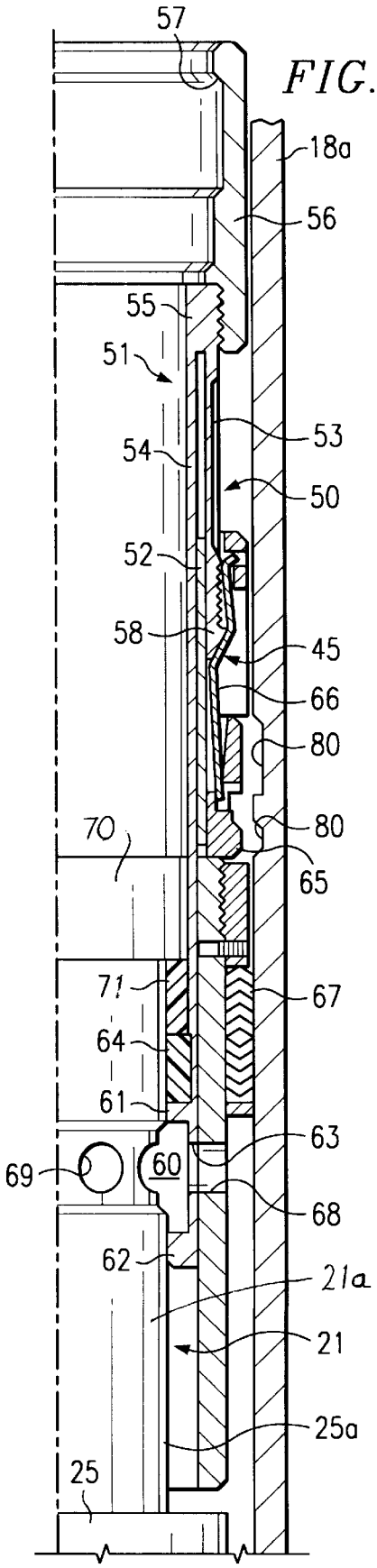
FIG. 3A is an enlarged, detailed sectional view taken within line 3—3 of FIG. 1 wherein the downhole pump is in an unlatched position within the string of production tubing.

Referring more particularly to the drawings, FIG. 1 discloses the downhole pump system 10 of the present invention when in an operable position within a wellbore 11. While wellbore 11 is shown as being cased with casing 11*a* having perforations 12 therein, it should be understood that the present invention can also be used in wells having "open-hole" completions. Basically, downhole pump system 10 is comprised of a submersible electric motor 13, gear box 14, protector seal section 15, and a perforated, intake section 16, all of which are threaded together and assembled onto the lower end of production tubing string 18. A seating/landing nipple 18*a* is assembled into string 18 at a point which will lie adjacent pump system 10 when the tubing 18 is in place within wellbore 11 for a purpose described above.

Electrical cable 19 for supplying electricity to rotary motor 13 is connected to motor 13 and is clamped to the outside of tubing 18 as the tubing is made-up and lowered into the well. Tubing 18, when in its operable position, will extend from the surface to a point adjacent producing formation F. As will be understood, motor 13 will drive gear box 14 which, in turn, has an output shaft 22 (FIG. 2) which passes through the protector seal section 16 and terminates within intake section 16. A drive or male gear 23 is fixed to the outer end of shaft 22 for a purpose described below.

Pump unit 21 is not fixed to tubing 18 but instead, is retrievably positioned within tubing 18 as will be described below. Pump unit 21 has been illustrated as being a progressive cavity (PC) pump which operates basically the same as most conventional, commercially-available PC pumps (e.g. "ESPCP", available from Centrilift, a Baker Hughes Co., Claremore, Okla.). While pump unit 21 is illustrated as a PC pump, it should be recognized that the pump of unit 21 can also be selected from other known types of submersible pumps, e.g. centrifugal pumps such as those available from Camco Reda Pumps, Bartlesville, Okla.

Pump unit 21 is comprised of a housing 25 which has an outside diameter smaller than the inner diameter of tubing 18 whereby pump unit 21 can easily pass through the tubing 18. As illustrated, pump 21 is a PC pump having a wobble joint or flexible shaft unit 25*a* which forms the lower end of housing 25 and is adapted to convert the concentric rotational motion of the drive shaft of motor 13 to the eccentric motion required to drive rotor 24 of the PC pump. An input shaft 26 (FIG. 2) extends from flex shaft unit 25*a* and has a driven, female gear 27 thereon.

The outer surface 28 of the lower end of housing 25*a* conforms to the seating surface 29 on landing nipple 18*a*. Preferably, both of the mating surfaces are "polished" to thereby form a seal between the tubing and the pump unit when the pump unit 21 is seated in nipple 18*a*. As shown in FIG. 2, one or more splines 33 are radially positioned around the lower end of housing 25*a*. These splines cooperate with slots 34 in collar 35 which, in turn, is secured within tubing 18 just above the seating surface 29. Each slot is open at the top of the collar and is adapted to receive a respective spline 33 when housing 25 is lowered into seating nipple 18*a* to thereby releasably latch the lower end of the housing 25 to nipple 18*a* and prevent relative rotation therebetween. The downhole pump system 10, as described to this point is basically the same as that disclosed and fully described in U.S. Pat. No. 5.746,582, issued May 5, 1998 and which is incorporated herein in its entirety by reference.

The downhole system described in U.S. Pat. No. 5,746,582 is illustrated as being positioned and/or retrieved by a wireline which, in turn, is releasably attached to the pump unit. While wireline technology is well developed in the industry and can also be used to position and retrieve the downhole pump system 10 of the present invention, there are instances where its use may be limited. For example, if wellbore 11 is a horizontal well or is inclined at a steep angle, e.g.. 60° or more, a wireline is normally inadequate for placing or retrieving the pump. Likewise, in a well which "makes" a lot of sand, the sand may accumulate within the wellbore and block the lowering of the pump on a wireline. Further, sand may accumulate on top of a pump already in place thereby blocking its removal by wireline. Also, in wells which produce heavy crudes, the necessary tension on wireline is difficult, if not impossible, to maintain during placement or removal of the downhole pump since the pump will not readily sink through the viscous liquid.

In the present invention, pump unit 21 is preferably positioned and retrieved on a string of coiled tubing. As used in the art, the term "coiled-tubing" refers to a long, continuous length of a relatively small-diameter, steel tubing 30 which is wound off and onto a large-diameter reel 31 which, in turn, is usually mounted on a trailer (not shown) or the like so that it can be moved from site to site when needed. Coiled tubing 30 is paid out from reel 31 and through an injector unit 32 into wellbore 11. Injector unit 31 is positioned above the wellhead of wellbore 11 and typically includes a pair of opposed, endless chain means 35 which, in turn, are driven in a timed relationship to grip tubing 30 and forcibly inject or withdraw the tubing into or out of well 11 depending on the direction in which the chains are driven. Injector units of this type are known and are commercially-available from various suppliers (e.g.. Hydra-Rig, Fort Worth, Tex.).

Coiled tubing 30 has a "running tool" 36 (e.g. "GS Running and Pulling Tool", Halliburton, Dallas, Tex.) on its lower end which, in turn, is releasably connected to pump unit 21 as will be understood in the art. It can be seen that as coiled tubing 30 is fed downward by injector unit 32, pump unit 21 will be "pushed" ahead by coiled tubing 30. By providing a positive downward force to pump unit 21, it can be moved through inclined/horizontal wellbores and/or through a wellbore having accumulated sand and/or viscous liquids therein. In those instances where an accumulated mass of sand may be such as not to allow the pump unit to be pushed therethrough, coiled tubing 30 can first be lowered without tool 36 and pump unit 21 and the sand can be washed out of the wellbore by pumping a wash fluid (e.g.. water) through the coiled tubing 30 and taking returns back to the surface through the annulus between the coiled tubing 30 and the production tubing 18.

In using coiled tubing 30 to install/retrieve the downhole pump unit 21 of the present invention, a "lubricator" 38 is provided to allow the pump unit 21 to enter and to be removed from the tubing string 18 without venting the wellbore pressures to the atmosphere. Lubricators are well known for this purpose but are normally mounted on and above the wellhead. In the present invention, if a typical lubricator is so mounted, it would have to extend for a substantial distance upward from the wellhead (e.g. 50 feet or more) thereby making its use totally impractical and unsafe in most instances.

In accordance with one aspect of the present invention, a lubricator sub 38 is incorporated into the string of production tubing 18 and forms a part thereof as the string of production tubing is made up and lowered into wellbore 11. Sub 38 is comprised of a length of conduit (i.e. basically the same dimensions as tubing 18) and includes a valve 40 for isolating the lubricator sub 38 from that portion of the tubing string 18 lying below the valve 40. Valve 40 is preferably a full opening, fail-safe (either open or closed), hydraulically actuated ball valve, (e.g. Downhole Safety Valves, Baker Oil Tools, Houston, Tex.). Valve 40 is actuated from the surface through hydraulic-fluid supply line 41. Lubricator sub 38 is typically positioned within tubing string 18 at least 50 feet below the surface and preferably is made-up about three "joints" of tubing down from the surface (e.g. 90 feet). This provides sufficient space within production tubing 18 between the wellhead and valve 40 for properly isolating the lower portion of the production tubing from the atmosphere during installing or retrieving the pump 21. By placing the lubrication downhole in tubing 18, the need projecting an above-ground lubricator substantial distances above the wellhead is eliminated.

When pump unit 21 is in its operable position within production tubing string 18, the lower end 25*a* of housing 25 is releasably latched within landing nipple 18*a* by splines 33 or the like (FIG. 2) while the upper end of the housing is releasably latched within nipple 18*a* by latch means 45. Since the distance "D" (FIG. 1) within nipple 18*a* between seat 29 and the upper latch means 45 is fixed, the respective length of pump unit 21 would have to exactly correspond to this same length with little, if any, tolerance. As anyone skilled in this art is aware, this is difficult to achieve in an actual field applications. Also, due to the fact that the tubing string 18 above pump 21 is typically filled with liquids, substantial forces have to be overcome before the pump unit 21 can be unlatched and raised to the surface through tubing 18, and if not compensated for, might lead to severe damage to the pump unit.

Figure 3B:
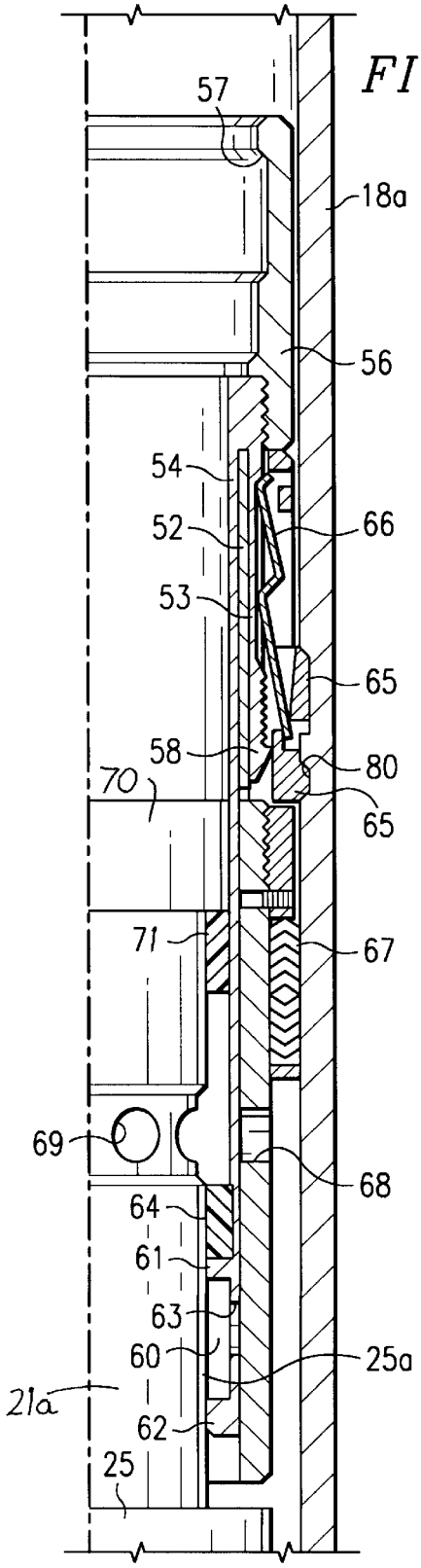
FIG. 3B is a sectional view, similar to FIG. 3A, with the downhole pump is in a latched position within the string of production tubing.

In accordance with the present invention, pump unit 21 includes a "slip joint" 50 at the upper end of pump unit 21. Referring more particularly to FIGS. 3A and 3B, slip joint 50 is comprised of a first member 51 and a second member 52. First member 51 is comprised of two circular legs 53, 54 which extend downward from a collar 55 which, in turn, is connected to coupling 56. Coupling 56 has an internal "fishing" shoulder 57 which is adapted to receive a compatible running/pulling tool (e.g. tool 36, FIG. 1).

Leg 53 carries expander 58 on the lower end thereof for a purpose to be more fully described below. Leg 54 is slidably positioned within second member 52 and has two annular shoulders 61, 62 on its lower end which are spaced from each other to define a chamber 60 which, in turn, has an opening 63 therein. A sealing means 64 is affixed to leg 54 above shoulder 61. Second member 52 carries expandable, latching dogs 65 which are normally biased outward by spring 66. Second member 52 also carries sealing means 67—which seals the annulus between pump 21 and production tubing 18—and has an opening 68 therethrough which aligns with opening 68 in first member 51 when pump unit 21 is in an unlatched position in tubing 18 (FIG. 3A).

Outlet conduit 21*a* of pump 21 extends upward from the top of housing 22 and has a collar 70 on the upper end thereof. Outlet 21*a* carries a sealing means 71 thereon which is in abutment with collar 70 and has a plurality of openings 69 therethrough. The lower end of leg 54 of first member 51 of slip joint 50 is slidably connected to the outlet conduit 21*a* wherein sealing means 64 on first member 51 abuts sealing means 70 on second member 52 to form a lifting connection between the member when slip joint 50 is in its extended position (FIG. 3A).

To originally install downhole, motor 13, gear box 14, protection section 15, inlet section 15, and landing/seating nipple 18*a* are connected to the lower end of production tubing string 18 as it is made-up and lowered into wellbore 11. Electric cable 19 is run at the same time and is clamped or otherwise secured to the outside of tubing string 18 as it is lowered. Pump unit 21 can be latched into landing nipple 18*a* and lowered as the tubing string 18 is lowered or it can be installed after the tubing 18 is in place within the wellbore 11.

To install pump unit 21 by lowering it through the tubing 18 after the tubing is in place, it is preferably releasably secured to the lower end of coiled-tubing string 30 by means of running tool 36 or the like. It should be recognized that pump unit 21 can also be run in on wireline if the situation permits. Valve 40 in the downhole lubricator 38 is closed until the pump unit 21 has been lowered into the upper portion of tubing 18 and the wellhead has been properly sealed, e.g. through a stuffing box or the like (not shown). Valve 40 is then opened and the coiled-tubing 30 is paid out from reel 31 to lower the pump unit 21 on down tubing 18.

As the pump unit is lowered, slip-joint 50 will be in its expanded position as shown in FIG. 3A. When in this position, opening 63 in first member 51 will be aligned with opening 68 in second member 52 and chamber 60 will be aligned with openings 69 in pump outlet 21*a*. These aligned openings provide a path for fluids in the wellbore below seal means 67 to flow into the interior of coiled-tubing 18, thereby equalizing the pressures above and below pump unit 21 thus allowing the pump unit to be lowered without having to "swab" the well fluids ahead of it.

When the lower end 25 of pump unit 21 engages the landing surface 29 in nipple 18*a*, continued downward movement of the coiled-tubing will now begin to move first member 51 downward with respect to second member 52 towards slip-joint's retracted position (FIG. 3B). As latch dogs 65 move down and become align with grooves 80 in nipple 18*a*, spring 66 forces the dogs into the respective grooves. Continued downward movement of first member 51 will move expander 58 in behind dogs 65 thereby latching them in grooves 80 (FIG. 3B). This type of releasable latching means is known in the art and has been used in certain commercially-available downhole tools, e.g. OTIS X ®, Lock Mandrel and Landing Nipple, Halliburton Co., Dallas, Tex.

When pump unit 21 is in its retracted or latched position (FIG. 3B), leg 54 of first member 51 will have moved down with respect to second member 52 wherein openings 63, 68 will no longer be aligned. Also, sealing means 64 on first member 51 will have moved down to a point below openings 69 in pump outlet conduit 21*a*. Now, when pump unit 21 is actuated, pumped fluids will flow through outlet conduit 21*a* and on up through tubing string 18. Any fluid which flows through openings 69 in outlet 21*a* will be contained between sealing means 64 and 70.

To retrieve pump unit 21, the running/pulling tool 36 is lowered on coiled-tubing string 30 and will engage and latch onto shoulder 57 of coupling 56 on first member 51 as will be understood in the art. As coiled-tubing 30 is reeled in, first member 51 will first move upward with respect to second member 52 of slip-joint 50. As first member 51 moves upward, expander 58 moves upward from behind dogs 65 and sealing means 64 on first member 51 moves into engagement with sealing means 70 on second member 52 (FIG. 3A). openings 63, 68 are now again in alignment and chamber 60 is aligned with openings 60 in outlet conduit 21*a*. This again equalizes the internal and external pressures adjacent pump unit 21 thereby substantially reducing the upward forces necessary to unlatch the pump unit 21 and lift it back to the surface through tubing string 18.

Now as the pump unit 21 is lifted, dogs 65 are free to cam out of slots 80 on nipple 18*a* thereby unlatching the pump unit for retrieval. By unlatching the pump unit and equalizing the pressures across the pump before the lifting forces are applied to the pump itself, less force is required to lift the pump unit and accordingly, there is considerably less risk in severely damaging the pump during retrieval.

What is claimed is:

1. A pump system for lifting formation fluids from a production zone in a wellbore, said system comprising:

a production tubing string adapted to extend from said production zone to the surface and having a landing nipple therein adjacent said production zone;

an electric motor fixed to the bottom of said tubing;

an electrical cable connected to said motor and extending along the outside of said production tubing; and a pump unit releasably positioned within said nipple and releasably connected to said motor, said pump unit being retrievable and installable through said tubing without removing said production tubing, said motor, or said electrical cable from said wellbore, said pump unit comprising:

a housing having an upper and a lower end;

an outlet conduit extending upward from said upper end of said housing; and a slip-joint slidably mounted on said upper end of said housing, said slip-joint having means for releasably latching said housing in said nipple; said slip-joint further comprising:

a first member slidably mounted on said outlet conduit;

a second member slidably mounted on said first member and carrying said means for releasably latching said housing in said nipple whereby said first member and said second member are in a first position in relation to each other as said pump unit is being installed and retrieved and in a second position with respect to each other when said pump unit is latched in said nipple; and openings in said outlet conduit, said first member, and said second member which align with each other to thereby provide a fluid passage for equalizing pressures in said production tubing above and below said pump unit when said slip-joint is in said first position.

2. The pump system of claim 1 including a lubricator section, said lubricator section comprising:

a length of conduit fluidly connected into and forming a part of said production tubing; and a valve for isolating said conduit from said production tubing below said conduit.

3. The pump system of claim 2 wherein said valve is a fully-opening, fail-safe, hydraulically operated ball valve.

4. The pump system of claim 2 wherein said lubricator section is positioned within said production tubing at a point which is at least 50 feet below said surface.

5. The pump system of claim 1 including:

a string of coiled tubing; and means for releasably connecting said coiled-tubing to said first member of said slip-joint whereby said pump unit is raised and lowered in said production tubing on said coiled-tubing.

6. A downhole pump unit adapted to be installed and retrieved on a running tool through a string of tubing positioned in a well, said tubing having an electrical motor fixed to the bottom thereof to which said downhole pump unit will be releasably connected to when said pump is in an operable position within said well tubing, said downhole pump unit comprising:

a housing;

a slip-joint mounted on said housing for equalizing the pressures across said pump unit during installation and retrieval, said slip-joint comprising:

a first member slidably mounted on said housing;

a second member slidably mounted on said first member and adapted to be connected to said running tool, said first member and said second member are in a first position in relation to each other as said pump unit is being installed and retrieved and in a second position with respect to each other when said pump unit is in said operable position within said well tubing; and openings in said housing, said first member, and said second member which align with each other to thereby provide a fluid passage for equalizing pressures in said well tubing above and below said pump unit when said slip-joint is in said first position and which are non-aligned to block flow therethrough when said slip-joint is in said second position.

7. The downhole pump unit of claim 6 wherein said housing has an upper and a lower end and an outlet conduit extending upward from said upper end of said housing;

and wherein said a first member is slidably mounted on said outlet conduit; and a second member is slidably mounted on said first member; and said means on said second member for releasably latching said housing in said operable position within said tubing.

* * * * *